United States Patent [19]

Brichta

[11] Patent Number: 4,784,036

[45] Date of Patent: Nov. 15, 1988

[54] AUTOMATIC CANNON AND FIRE CONTROL MECHANISM

[75] Inventor: Karl Brichta, Ebergassing, Austria

[73] Assignee: Steyr-Daimler-Puch AG, Vienna, Austria

[21] Appl. No.: 73,491

[22] Filed: Jul. 15, 1987

[30] Foreign Application Priority Data

Jul. 17, 1986 [AT] Austria ..... 1947/86

[51] Int. Cl.[4] ..... F41F 13/04

[52] U.S. Cl. ..... 89/136; 89/27.3

[58] Field of Search ..... 89/132, 136, 27.3, 128; 42/69.01

[56] References Cited

U.S. PATENT DOCUMENTS 1,628,227 5/1927 Browning .
2,186,969 1/1940 Green .
2,465,271 3/1949 Ruau .
4,196,653 4/1980 Jackson ..... 89/136

FOREIGN PATENT DOCUMENTS 2742241 3/1979 Fed. Rep. of Germany ..... 89/132
3001490 7/1981 Fed. Rep. of Germany .
111900 9/1944 Sweden ..... 89/27.3

*Primary Examiner*—Deborah L. Kyle
*Assistant Examiner*—Stephen Johnson
*Attorney, Agent, or Firm*—Marmorek Guttman & Rubenstein

[57] ABSTRACT

A fire control mechanism (4) for an automatic cannon comprises a trigger control member (6), which engages the trigger (3) of the cannon structure (2) and is operable by an actuator (5) to move from an inoperative position against a restoring force to an operative position for operating the trigger. To ensure that the cannon has a capability not only for sustained fire but also for a reliable firing of single shots operative connection between the actuactor (5) and the trigger control member (6) is provided by a clutch (16). An end stop (16) is provided, which is selectively movable to and from an inoperative position and only in said operative position is arranged to disengage said clutch when the actuator has performed the movement which is required to move the trigger control member from its inoperative position to its operative position.

8 Claims, 2 Drawing Sheets

2
3
6
8
12
14
11
4
5
19
18
16
15
17
13
9
10
7
1

AUTOMATIC CANNON AND FIRE CONTROL MECHANISM

BACKGROUND OF THE INVENTION

1. Field of the Invention

This invention relates to an automatic cannon and to a fire control mechanism for automatic cannons, comprising a trigger control member, which is engageable with the trigger of the cannon and is operable by an actuator to move against a restoring force from an inoperative position to an operative position for operating the trigger.

2. Description of the Prior Art

Automatic cannons are weapons which are capable of sustained fire and will shoot automatically as long as the trigger is operated. Separate fire control mechanisms are provided, which serve to operate the trigger and are mounted on the cradle of the cannon and comprise a trigger control member for raising the trigger so as to initiate a burst. The trigger is mounted on the cannon proper, which is longitudinally movably mounted on the cannon proper, which is longitudinally movably mounted on the cradle so that the recoil can be taken up. The trigger control member is operatively connected to an actuator, which may consist of a hydraulic cylinder, an electromagnet or a power screw and which is operable to raise the trigger control member from an inoperative position to an operative position for operating the trigger when the cannon is to be fired. When the actuator is de-energized or reversed, a restoring force which is exerted in a suitable manner by a spring or weight bias returns the trigger control member to its inoperative position so that the trigger is no longer operated and the burst is terminated. Because such automatic cannons have a high firing rate and the actuator has an inertia and because the operator has a rather long reaction time, most of the known automatic cannons are not capable of firing single shots.

Published German Application No. 30 01 490 discloses a fire control mechanism for automatic weapons in which two two-armed levers and an adjustable stop can cooperate for a firing of bursts and individual shots. For a firing of bursts the rotation of one of the levers, which is connected to an actuating rod, is limited by the stop in such a manner that the first mentioned lever can turn the other lever to its trigger-operating position and can maintain said other lever in said triggeroperating position. For a firing of single shots the stop is moved out of the range of the first-mentioned lever so that the pulling of the actuating rod will cause the first-mentioned lever to move the second lever to its trigger-operating position and immediately thereafter to release the second lever because the firstmentioned lever is being pulled through the firing position without engaging the stop. In that case, the acuating rod must undesirably be moved over different distances for a firing of single shots and of bursts, the reliability in operation will depend on a highly exact adjustment of the levers and of the stop and the entire fire control mechanism occupies a relatively large space and must be accommodated in a separate housing, which is mounted on the cannon.

SUMMARY OF THE INVENTION

It is an object of the invention to eliminate said disadvantages and to provide a fire control mechanism which is of the kind described first hereinbefore and involves a relatively low structural expenditure and space requirement and permits a reliable firing of single shots and bursts under constant firing conditions.

That object is accomplished in accordance with the invention in that the operative connection between the actuator and the trigger control member is provided by a clutch and an end stop is provided, which is movable to an operative position and only in said operative position is arranged to cause the clutch to be disengaged as the actuator performs a movement in excess of the movement required to move the trigger control member from its inoperative position to its operative position. When the end stop is inoperative, the clutch remains engaged and the actuator and trigger control member will be operatively connected regardless of the position of the actuator so that the fire control mechanism can be used in the usual manner for sustained fire and for a firing of bursts. On the other hand, when the end stop is in operative position, it will disengage the clutch as soon as the trigger control member has reached its operative position and has operated the trigger to fire a shot. At the same time, the interruption of the operative connection between the actuator and the trigger control member permits the trigger control member to be restored to its inoperative position by the restoring force so that the firing is terminated.

In that case the trigger control member can operate the trigger only until a single shot has been fired and an automatic firsing after the discharge of the first shot will not be possible regardless of whether the reaction of the operator is fast or slow or whether the actuator is de-energized or reversed quickly or slowly. Because the end stop can selectively be used, the fire control mechanism can reliably be changed from a sustained fire to the firing of single shots and vice versa in a reliable manner without a need of altering the design of the entire cannon.

The operative connection between the acuator and the trigger control member may be provided by any suitable means and said means may be provided with any suitable clutch which is capable of interrupting the operative connection at the desired time. In a preferred embodiment of the invention the trigger control member is adapted to be raised and lowered and the slider is provided, which is connected to the actuator by a strap and provided with a run-up ramp for actuating the trigger control member. In that case a particularly suitable design will be obtained if the strap carries a coupling pin, which extends into a slot that is formed in the slider and has a length which corresponds to the stroke of the trigger control member, and a pawl is pivoted to the slider on an axis which is transverse to the direction of movement of the slider and together with the coupling pin constitutes a clutch, in which the pawl interlocks with the coupling pin so as to engage the clutch whereas the pawl is adapted to be pivotally raised against the force of a clutch-engaging spring by means of an actuating lever, which protrudes into the range of the end stop when the latter is in its operative position, so that the pawl will then be disengaged from the coupling pin. In such a fire control mechanism the actuator displaces the slider to such an extent that the run-up ramp raises the trigger control member, which is moved, e.g., by a parallel-crank mechanism, and forces said trigger control member against the trigger. When the actuator is de-energized, the weight of the trigger control member and the force of the restoring spring which biases the trigger cause the slider to be pushed back to its initial position. The reciprocating slider thus imparts the desired reciprocating movement to the trigger control member. When the pawl interlocks with the coupling pin, the latter will be locked to the slider within the slot to establish a positive connection between the slider and the actuator, e.g. by means of the strap, and the fire control mechanism will be ready for a sustained fire because the end stop is inoperative. On the other hand, when the end stop is in operative position, in which it protrudes into the path of the lever for actuating the pawl, and is struck by the actuating lever, the stop will cause the pawl to be raised so as to release the coupling pin in the slot. Because the end stop will become effective as soon as the trigger control member has performed the movement which is required to actuate the trigger so that the first round is discharged, the pawl will release the coupling pin exactly at the same time so that the operative connection between the actuator and the trigger control member will be interrupted and a firing of additional shots will be prevented. Because the pawl is now disengaged from the coupling pin, the slider is displaceable relative to the actuator so that the trigger control member and the slider will be forced back to their inoperative positions immediately after the discharge of the first round and the unlocked coupling pin and its play within the slot will ensure that said movement will be permitted regardless of the instantaneous position and energization of the actuator. For a renewed firing of the cannon, the actuator must be re-energized to interengage the pawl, which is spring-loaded in the clutch-engaging sense, with the coupling pin so that the operative connection is re-established by said automatic engagement of the clutch and the cannon can be used for the next signle shot or for a sustained fire in dependence on the selection and use of the end stop.

For a single change from a firing of single shots to sustained fire and vice versa, the end stop is mounted on a swivel arm, which is preferably connected to a turning knob so that the end stop can be moved by a small pivoted movement into and out of its operative position in the path of the actuating lever.

DETAILED DESCRIPTION OF THE PREFERRED EMBODIMENT

Figure 1:
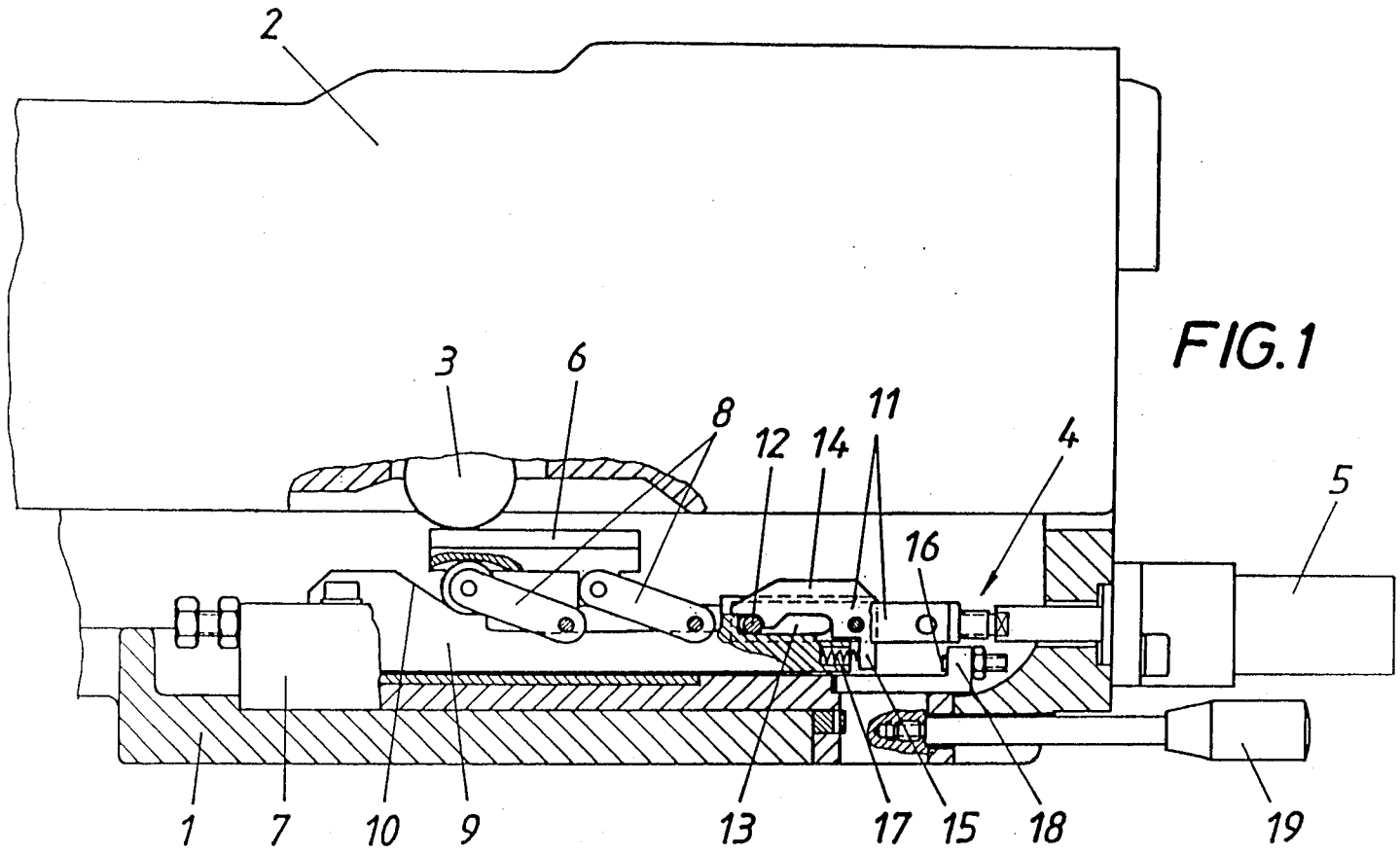
FIG. 1 is a longitudinal sectional view showing a fire control mechanism in accordance with the invention.

An illustrative embodiment of the invention is diagrammatically shown on the drawing.

A cannon structure 2 is longitudinally movably mounted on a cradle 1 and is arranged to be fired by the operation of a trigger 3. The duration of the burst will be automatically controlled by the time for which the trigger is operated. A fire control mechanism 4 for operating the trigger 3 is mounted on the cradle 1 and comprises a trigger control member 6, which engages the trigger 3 and is operable by an actuator 5. The trigger control member 6 is mounted by means of parallel cranks 8 on a holder 7, which is secured to the cradle 1, so that the trigger control member 6 can be moved up and down. A slider 9 is longitudinally guided in the holder 7 and is operatively connected to the acutator 5 and formed with a run-up ramp 10, which cooperates with the parallel cranks 8 to raise the trigger control member 6 and to permit it to be lowered. The actuator 5 is operatively connected to the slider 9 by means of a forked strap 11, which is pivoted to the actuator 5 and carries a transverse coupling pin 12, which extends into a slot 13 that is formed in the slider 9. A pawl 14 is pivoted on a transverse axis to the slider 9 adjacent to the actuator 5 and together with the coupling pin 12 constitutes a clutch, in which the pawl 14 is interengageable with the coupling pin 12 to lock the latter at the forward end of the slot 13, as is shown in FIG. 1. The pawl 14 is connected to a clutch-disengaging lever 15, which is adapted to cooperate with an end stop 16 to pivotally raise the pawl 14 against the force of a clutch-engaging spring 17 as soon as the slider 9 has been displaced in a predetermined direction to effect the firing of a shot and the movement of the actuator 5 in that direction is continued. When the pawl 14 has thus been raised, the coupling pin 12 is unlocked. The end stop 16 is mounted on a swivel arm 18, which is pivotally movable by means of a turning knob 19 so that the end stop 16 can be pivotally moved into and out of the path of the clutch-disengaging lever 15.

For a sustained fire, the end stop 16 is turned to an inoperative position. When the actuator 5 is then energized it will pull by means of the strap 11 and the coupling pin 12, which is locked in the slot 13 by the pawl 14, the slider 9 to the right in FIG. 1 so that the run-up ramp 10 of the slider 9 engages the parallel cranks 8 and raises the latter and the trigger control member 6 is thus raised from its inoperative position to its operative position, in which the trigger 3 is operated. Because the end stop 16 is now in its inoperative position, the pawl 14 continues to lock the coupling pin 12 also when the trigger control member 6 is in its operative position and the cannon will continue to fire until the trigger control member 6 has been lowered from its operative position to its inoperative position because the actuator 5 has been de-energized so that the spring-loaded trigger 3 has automatically depressed the trigger control member 6 and has caused the slider 9 to be returned to its initial position by the parallel cranks 8 engaging the run-up ramp 10.

Figure 2:
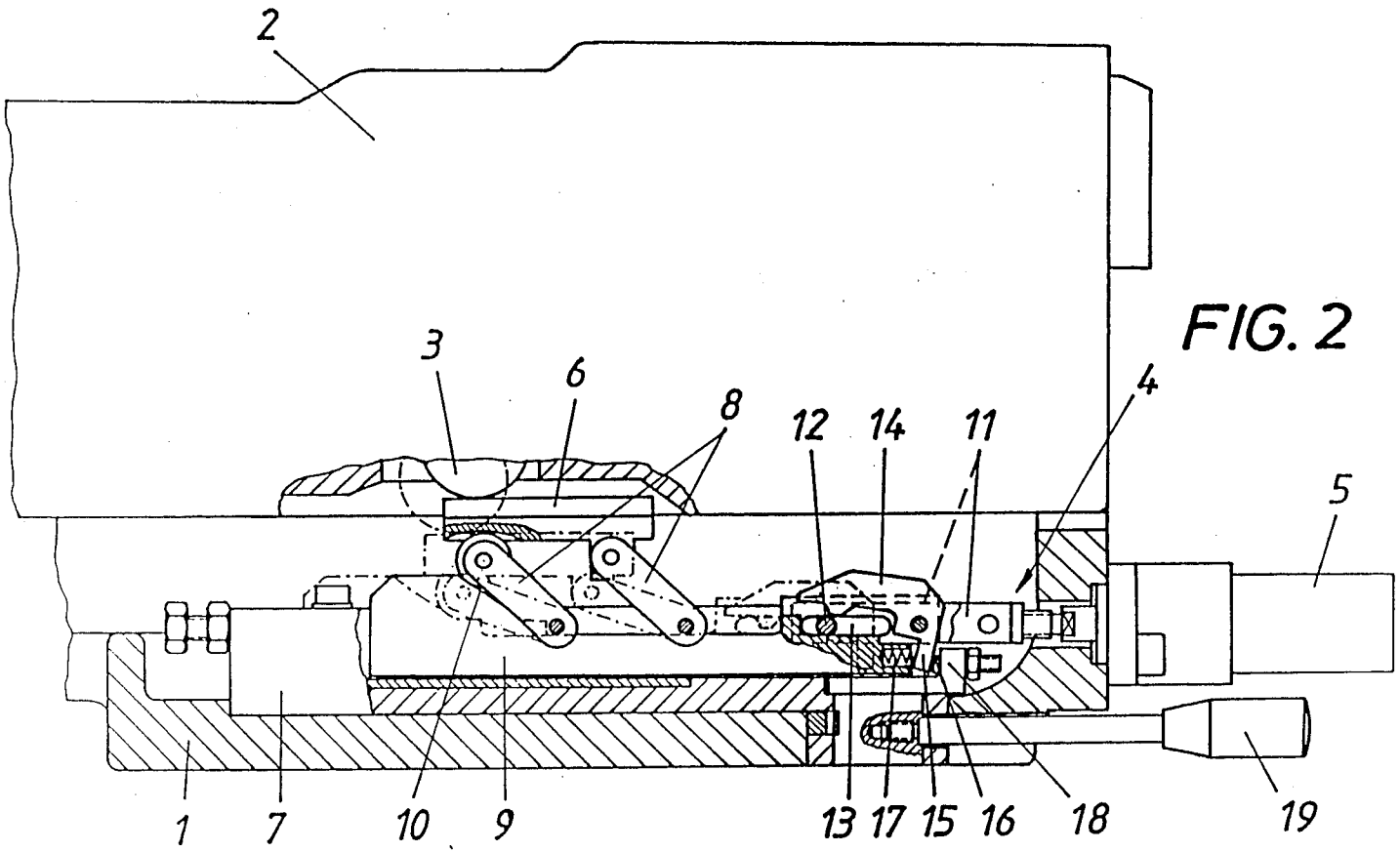
FIG. 2 is a longitudinal sectional view showing the same fire control mechanism in condition for a firing of single shots.

For a firing of single shots, it is sufficient to turn the knob 19 so as to move the end stop 16 to its operative position in the path of the clutch-disengaging lever 15 so that the cannon is no longer capable of sustained fire. When the slider 9 is being retracted to fire a shot and the trigger control member 6 has reached its operative position the end stop 16 engages the clutch-disengaging lever 15 so that the pawl 14 will disengage the coupling pin 12 because the end stop 16 is in its operative position, which is so selected that the clutch-disengaging lever 15 will engage the end stop 16 as soon as the trigger control member has reached its operative position. As a result, the pawl 14 will release the coupling pin 12 as soon as the first shot has been fired (FIG. 2). Because the coupling pin 12 is now released, the operative connection between the actuator 5 and the slider 9 is interrupted and the spring-loaded trigger 3 can return the trigger control member 6 to its inoperative position as soon as the first shot has been fired. This is due to the fact that the released coupling pin 12 permits the slider 9 to perform relative to the strap 11 a movement to the extent of the length of the slot 13 and as the trigger control member 6 is lowered the slider 9 can also be returned to its initial position by the action of the parallel cranks 8 on the run-up ramp 10 because such movement is not opposed by the actuator 5 or the strap 11. (The resulting position is indicated in phantom in FIG. 2.) A single shot has now been disengaged. Before a second shot can be fired, the coupling pin 12 must again be locked by the pawl 14. This is automatically effected in that the coupling pin 12 is moved to the pawl 14 by means of the actuator 5 and the strap 11. Only when the coupling pin 12 has again been locked by the pawl 14 in the position shown in FIG. 1) can the actuator 5 be energized to fire another stop, which will be a single shot or the first shot of a burst or sustained fire in dependence on the position of the end stop 16.

I claim:

1. In an automatic cannon comprising a cradle, a cannon structure, which is reciprocably mounted on said cradle and comprises a trigger, which is opeable to fire said cannon, a fire control mechanism, which is mounted on said cradle and comprises a trigger control member, which is movable between an inoperative position and an operative position and in said operative position is arranged to operate said trigger, an actuator, which is operable to move a predetermined distance in a predetermined direction for moving said trigger control member from said inoperative position to said operative position and is operable to move in excess of said predetermined distance, and restoring means for restoring said trigger control member to said inoperative position, the improvement residing in that a clutch is provided for operatively connecting said actuator to said trigger control member, clutch-disengaging means are connected to said actuator and operable to disengage said clutch, and an end stop is mounted on said cradle and selectively movable between a first position and a second position and only in said second position is arranged to operate said clutch-disengaging means to disengage said clutch as said actuator moves in excess of said predetermined distance.

2. The improvement set forth in claim 1 as applied to an automatic cannon in which said trigger control member is arranged to be raised from said inoperative position to said operative position and said fire control mechanism comprises a slider, which is slidably mounted on said cradle for a movement in said predetermined direction and is coupled to said actuator and comprises a run-up ramp for raising said trigger control member to said operative position in response to said predetermined movement of said actuator, wherein said slider is formed with a slot extending in said predetermined direction and having a length which is equal to said predetermined distance, said clutch comprises a coupling pin, which is connected to said actuator and extends through said slot transversely to said predetermined direction, and a pawl, which is pivoted to said slider on an axis which is transverse to said predetermined direction, said pawl being adapted to interengage with said coupling pin so as to lock said coupling pin in said slot to said slider, and a clutch-disengaging spring urging said pawl to interengage with said coupling pin, and said clutch-disengaging means comprise a lever, which is connected to said pawl and engageable with said end stop so as to disengage said pawl from said coupling pin against a force of said clutching-engaging spring.

3. The improvement set forth in claim 1, wherein said end stop is mounted on a swivel arm, which is pivotally movable to move said end stop between said first and second positions.

4. The improvement set forth in claim 3, wherein said swivel arm is connected to a knob for pivotally moving said arm.

5. In a fire control mechanism for an automatic cannon comprising a cradle and a cannon structure, which is reciprocably mounted on said cradle and comprises a trigger, which is operable to fire said cannon, said fire control mechanism being adapted to be mounted on said cradle and comprising a trigger control member, which is movable between an inoperative position and an operative position and in said operative position is arranged to operate said trigger, an actuator, which is operable to move a predetermined distance in a predetermined direction for moving said trigger control member from said inoperative position to said operative position and is operable to move in excess of said predetermined distance, the improvement residing in that a clutch is provided for operatively connecting said actuator to said trigger control member, clutch-disengaging means are connected to said actuator and operable to disengage said clutch, and an end stop is mounted on said cradle and selectively movable between a first position and a second position and only in said second position is arranged to operate said clutch-disengaging means to disengage said clutch as said actuator moves in excess of said predetermined distance.

6. The improvement set forth in claim 5 as applied to a fire control mechanism in which said trigger control member is arranged to be raised from said inoperative position to said operative position and said fire control mechanism comprise a slider, which is slidably mounted on said cradle for a movement in said predetermined direction and is coupled to said actuator and comprises a run-up ramp for raising said trigger control member to said operative position in response to said predetermined movement of said actuator, wherein said slider is formed with a slot extending in said predetermined direction and having a length which is equal to said predetermined distance, said clutch comprises a coupling pin, which is connected to said actuator and extends through said slot transversely to said predetermined direction, and a pawl, which is pivoted to said slider on an axis which is transverse to said predetermined direction, said pawl being adapted to interengage with said coupling pin so as to lock said coupling pin in said slot to said slider, and a clutch-engaging spring urging said pawl to interengage with said coupling pin, and said clutch-disengaging means comprise a lever, which is connected to said pawl and engageable with said end stop so as to disengage said pawl from said coupling pin against a force of said clutch-engaging spring.

7. The improvement set forth in claim 5, wherein said end stop is mounted on a swivel arm, which is pivotally movable to move said end stop between said first and second positions.

8. The improvement set forth in claim 7, wherein said swivel arm is connected to a knob for pivotally moving said arm.

* * * * *